US005640873A

United States Patent [19]

Costabile

[11] Patent Number: 5,640,873

[45] Date of Patent: Jun. 24, 1997

[54] PUNCH AND DIE ASSEMBLY

[76] Inventor: Arvid Bennett Costabile, 10669 E. Desert Willow Dr., Scottsdale, Ariz. 85255

[21] Appl. No.: 441,050

[22] Filed: May 15, 1995

[51] Int. Cl.[6] ..... B21D 5/02

[52] U.S. Cl. ..... 72/316; 72/379.2; 72/386

[58] Field of Search ..... 72/316, 322, 379.2, 72/406, 325, 312–315, 386

[56] References Cited

U.S. PATENT DOCUMENTS

| | | | |
|---|---|---|---|
| 1,556,166 | 10/1925 | Sievert | 72/322 |
| 2,869,611 | 1/1959 | Stalker | 72/322 |
| 3,460,372 | 8/1969 | Ashworth | 72/386 |
| 4,002,049 | 1/1977 | Randolph | 72/313 |

FOREIGN PATENT DOCUMENTS

| | | | |
|---|---|---|---|
| 43407 | 11/1965 | Germany | 72/312 |
| 87932 | 5/1984 | Japan | 72/315 |

*Primary Examiner*—Daniel C. Crane
*Attorney, Agent, or Firm*—Tod R. Nissle, P.C.

[57] ABSTRACT

A punch and die assembly includes a punch plate that is displaced in a selected direction of travel to carry the punch toward the die. The punch simultaneously moves laterally with respect to the punch plate and moves rectilinearly divergently away from the direction of travel of the punch plate.

3 Claims, 3 Drawing Sheets

PUNCH AND DIE ASSEMBLY

This application pertains to a punch and die assembly for deforming a sheet of material.

More particularly, the invention pertains to a punch and die assembly which includes a punch plate that is displaced in a selected direction of travel to carry the punch toward the die.

In another respect, the invention pertains to a punch and die assembly which bends a portion of a sheet of material through an obtuse angle during a single stroke of the punch plate in a selected direction of travel.

In a further respect, the invention pertains to a punch and die assembly of the type described in which the punch simultaneously moves laterally with respect to the punch plate and moves rectilinearly divergently away from the direction of travel of the punch plate.

Punch and die assemblies are well known in the art. See, for example, U. S. Pat. Nos. 4,170,890 to Kojima, 3,625,038 to Swigert, 5,099,675 to Heath, 3,511,072 to Oddy, 4,873,752 to Suck, 4,969,345 to Zonneveld et al., 4,571,975 to Pawloski et al., and 4,682,487 to Kaeseler. See also Russian Patent No. 1,333,444 (Abstract by Derwent Publications Ltd.), Japanese Patent No. 60-102,235 (Abstract), "Seven Ways to Control Springback" (Machinery Vol 72, No. 11 July 1967, pp. 78, 79), and "Tool Engineering" (Machinery, December, 1964, Vol. 71, No. 4, p. 144). Such prior art assemblies ordinarily displace a punch in a direction normal to a piece of sheet material in order to bend a portion of the sheet material through an arc or a displacement angle of ninety degrees.

In order to compensate for springback which occurs when a metal tab on a piece of sheet metal is bent, it is, however, often desirable to bend the tab through an arc or a displacement angle in excess of ninety degrees so that when the tab metal "springs back", it is at an angle of about ninety degrees with respect to the remainder of the sheet metal piece. Bending a metal tab through a displacement angle in excess of ninety degrees requires a two step process in which the tab is (1) bent through an angle of ninety degrees by a conventional punch and die assembly of the type noted above, and (2) laterally displaced in order to deflect the metal through a angle in addition to the initial ninety degree displacement angle. Such two step metal forming processes are labor intensive and require capital expenditures for at least two different pieces of equipment.

Accordingly, it would be highly desirable to provide an improved punch and die assembly which could in a single operation deform a portion of a piece of sheet material through an obtuse angle.

Therefore, it is a principal object of the invention to provide an improved punch and die assembly for deforming a piece of material.

Another object of the invention is to provide an improved punch and die assembly which can bend a portion of a piece of sheet material through an obtuse angle during only a single stroke of the punch.

These and other, further and more specific objects and advantages of the invention will be apparent to those skill in the art from the following detailed description thereof, taken in conjunction with the drawings, in which.

Briefly, in accordance with my invention, I provide a punch and die assembly for bending a portion of a piece of sheet material through an obtuse angle. The punch and die assembly includes a punch plate including an opening; a punch having a proximate end mounted in the opening in the punch plate and having a distal end extending outwardly from the punch plate, the opening permitting the punch to slide laterally in the punch plate; a guide plate—die assembly including a guide plate, a guide hole extending through the guide plate for slidably receiving and guiding the distal end of the punch during rectilinear movement of the distal end of the punch through the guide hole, and a die having a working opening formed therein adjacent the guide hole. The working opening includes a working surface oriented at an angle to a sheet workpiece on the die. The workpiece includes a portion positioned over the working opening. The opening in the punch plate, the guide hole, the working opening, and the punch are shaped and dimensioned such that when at least one of the pair comprising the punch plate and the guide plate-die assembly is moved toward the other of said pair in a selected direction of travel then (1) the proximate end of the punch slides in the opening in the punch laterally with respect to the selected direction of travel, (2) the distal end of the punch slides rectilinearly through the guide hole, and (3) the distal end of the punch bends the portion of the workpiece into said workpiece opening toward the working surface and through an angle greater than ninety degrees.

Figure 1:
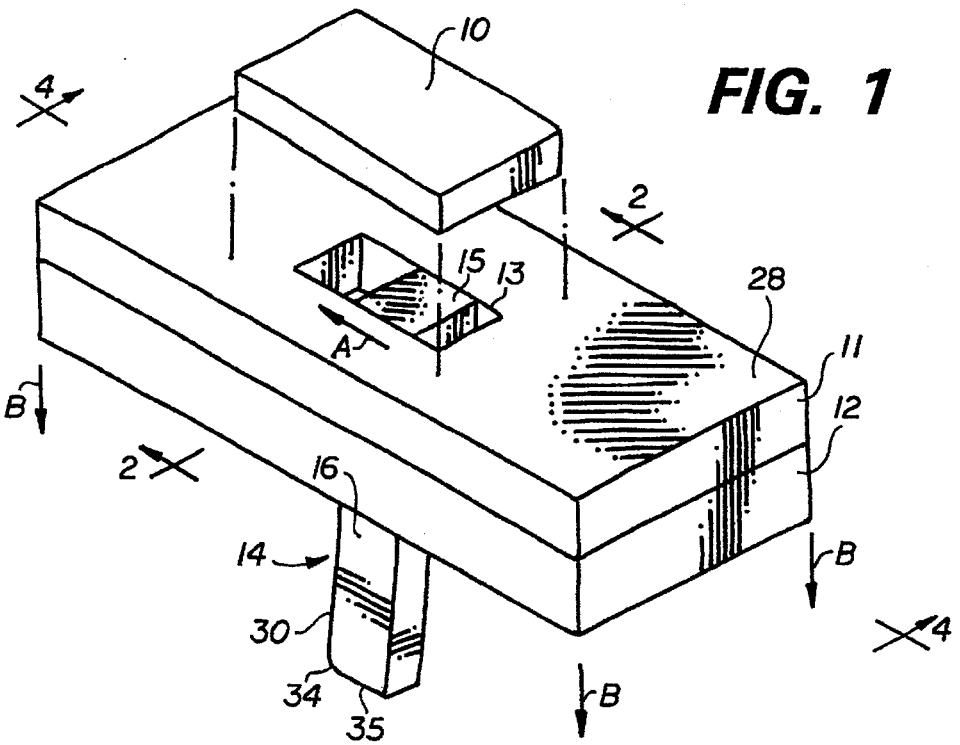
FIG. 1 is a perspective view illustrating the punch and the punch plate of a punch and die assembly as constructed in accordance with the principles of the invention.
Figure 2:
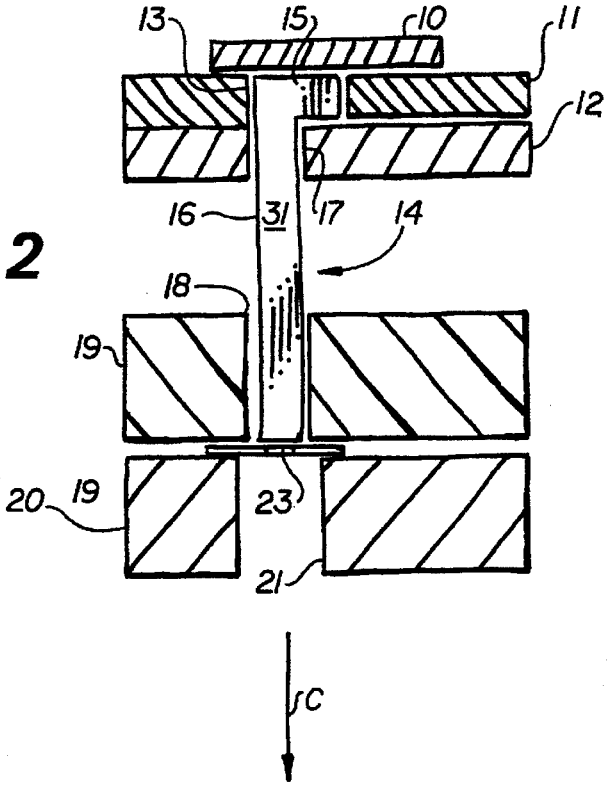
FIG. 2 is a side section view of the punch and die assembly of FIG. 1 illustrating further construction details thereof and taken along section lines 2—2 thereof.

Turning now to the drawings, which depict the presently preferred embodiments of the invention for the purpose of illustrating the practice thereof, and not by way of limitation of the scope of the invention, and in which like reference characters refer to corresponding elements throughout the several views, FIG. 1 illustrates the punch 14 and the punch plate of a punch and die assembly constructed in accordance with the invention. Punch 14 includes distal end 16 extending outwardly from the punch plate and includes proximate end 15. The punch plate includes rectangular plates 10, 11, 12 which are held together in the configuration shown in FIGS. 2 and 4 by bolts, rivets, welds or any other desired fastening components. An opening formed in the punch plate includes a rectangular opening 13 formed through plate 11 and a rectangular opening 17 formed through plate 12. Openings 13 and 17 are shaped and dimensioned such that proximate end 15 is held captive in and cannot be removed from the punch plate. Openings 13 and 17 are, however, sized such that proximate end 15 is free to slide laterally in the punch plate and in openings 13 and 17 in the direction of arrow A (or in a direction opposite that of arrow A).

Figure 4:
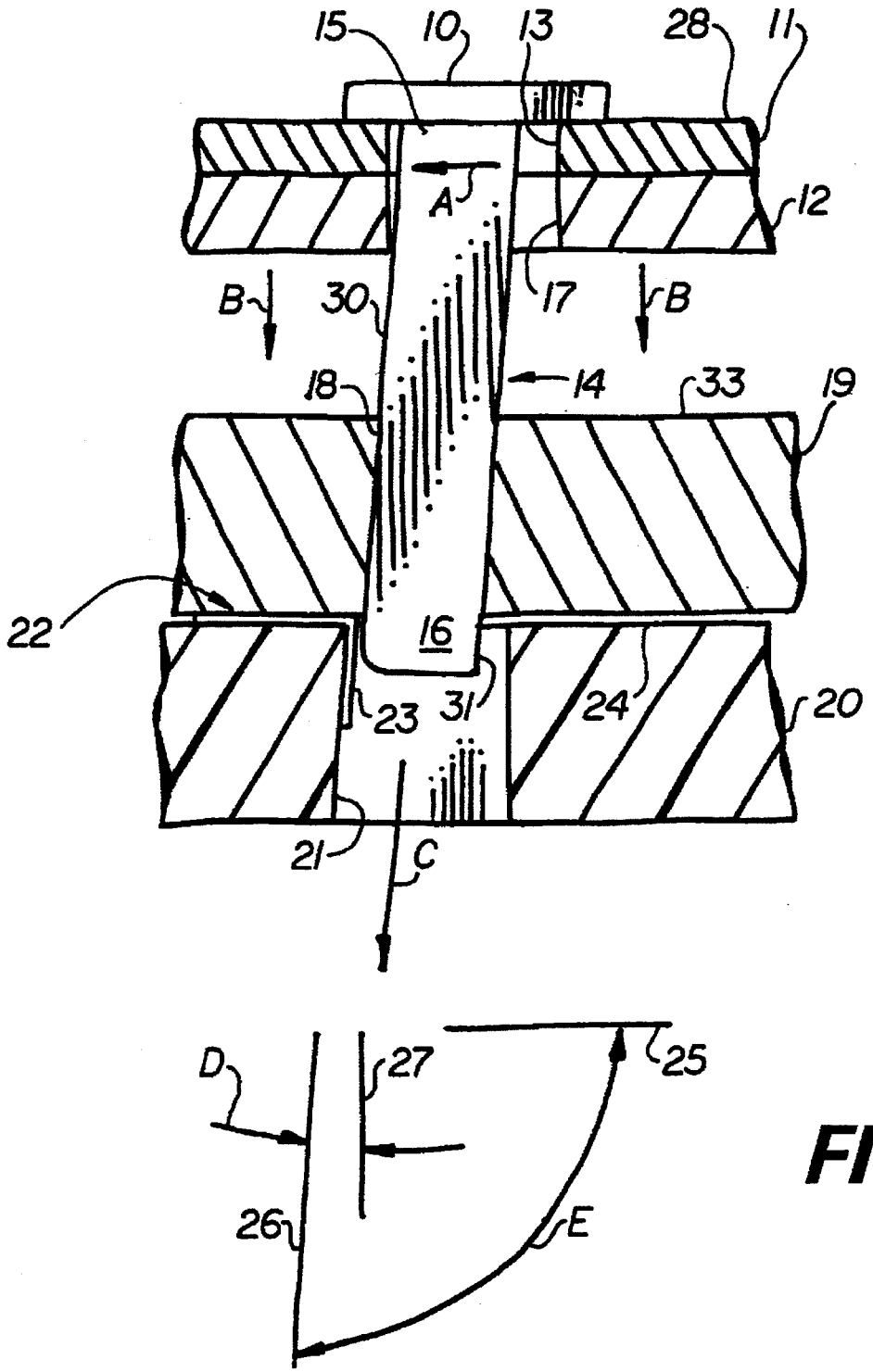
FIG. 4 is a front section view of the punch and die assembly of FIG. 1 illustrating the mode of operation thereof and taken along section lines 4—4 thereof.

The elongate, rectangular, straight distal end 16 of punch 14 is, as can be readily seen in FIG. 4, canted with respect to the flat planar surfaces 24 and 28 of die 20 and plate 11, respectively. End 16 is not normal to plates 10, 11, 12 nor to guide plate 19 and die 20. End 16 includes front and back rectangular parallel spaced-apart surfaces 30, 31 which are each of substantially the same shape and dimension.

Guide hole or aperture 18 formed through guide plate 19 is shaped and dimensioned to slidably receive and guide distal end 16 when it travels rectilinearly through aperture 18 in the direction of travel indicated by arrow C in FIG. 4. Aperture 18 conforms to the distal end 16 of punch 14 to insure that punch 14 slides through aperture 18 in the direction indicated by arrow C in FIGS. 2 and 4.

A working opening is formed through die 20 and is adjacent guide aperture 18. The working opening includes a work surface 21 which is preferably substantially parallel to the rectilinear direction of travel C and to surface 30 of distal end 16 of punch 14. The angle E (FIG. 4) between work surface 21 and surfaces 24, 28 is indicated by arrows E in FIG. 4, where line 25 is parallel to surfaces 24, 28 and to plates 10, 11, 12, 19 and die 20. Angle E is an obtuse angle which is normally less than or equal to about one-hundred and five degrees. In FIG. 4, line 27 is perpendicular to plates 10, 11, 12, 19 and flat planar surfaces 28, 33, and 24. Line 26 is parallel to and collinear with work surface 21. Accordingly, the angle indicated by arrows D is normally less than or equal to about fifteen degrees. And, surfaces 30 and 31 and the longitudinal axis of distal end 16 are ordinarily each at a common acute angle of less than or equal to about fifteen degrees with respect to each of surfaces 24, 33, 28.

Motive power means is provided to displace plates 10 to 12 downwardly in the direction of arrows B and then upwardly in a direction parallel to but opposite that of arrows B. Such motive power means—including gears, motors, controls, etc.—is well known in the art and will not be described herein. A table or other support structure (not shown) is provided to support plate 19 and die 20 in a desired fixed position.

As would be appreciated by those of skill in the art, a plurality of working openings can be formed through die 20; a plurality of guide holes can be formed through guide plate 19 with each such guide hole adjacent a sister working opening to form a working opening-guide hole pair; and, a plurality of opening pairs 13–17 can be formed in plates 11, 12 such that each opening pair 13–17 can receive the distal end of a separate punch 14 and such that each opening pair 13–17 is operatively associated with a different working opening-guide hole pair formed in plates 19 and 20. Each die 14 extending from an opening pair 13–17 would be downwardly displaced through a different working opening-guide hole pair when plates 10 to 12 were downwardly displaced in the direction of arrows B in FIGS. 1 and 4.

Figure 3:
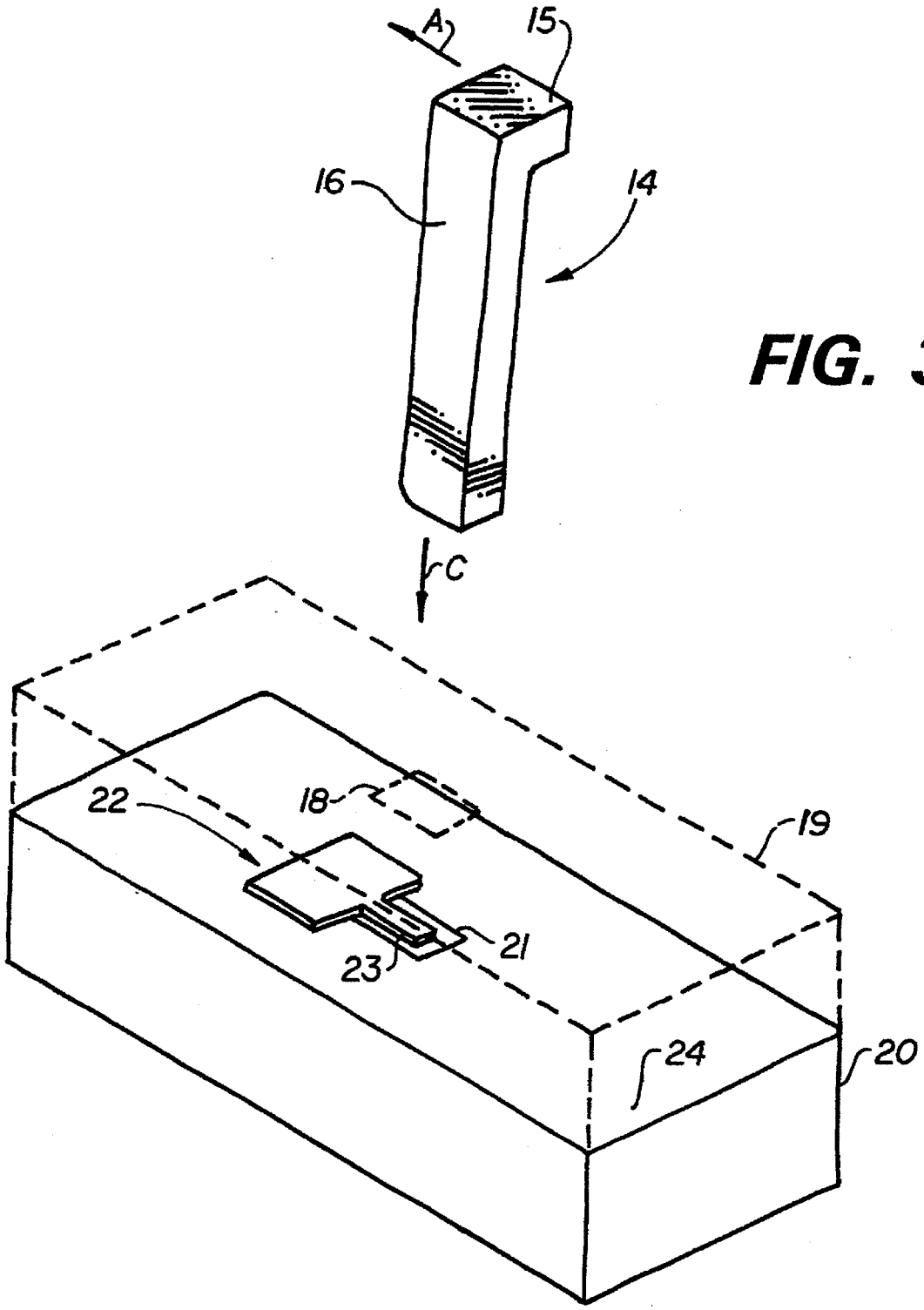
FIG. 3 is a perspective view illustrating the rectilinear travel of the punch into the guide plate and into the die of the punch and die assembly of the invention.

In operation, a piece 22 of sheet metal or of another material is placed on the surface 24 of die 20 (FIG. 3) with a tab or other portion 23 of the metal positioned over a working opening having a work surface 21. The piece 22 of sheet metal is temporarily secured in position by pressing guide plate 19 against piece 22 and toward surface 24. Piece 22 can also be secured in position with fasteners or by any other desired method. The distal end 16 of punch 14 is in the position shown in FIG. 2 and is just above piece 22. The proximate end 15 of the punch 41 is, with reference to FIG. 4, over on the right hand side of openings 13 and 17, instead of being on the left hand side of openings 13 and 17 as shown in FIG. 4. The motive power means is then activated to displace the punch plate downwardly in the direction of arrows B in FIGS. 1 and 4. Die 20 and guide plate 19 remain stationary. The direction indicated by arrow B is normal to surface 24, 28, and 33. Downwardly displacing the punch plate causes the distal end 16 to slide through aperture 18 and into the working opening in die 20. When distal end 16 moves into the working opening, the bottom surface 35 of end 16 first contacts and displaces tab 23, followed by the radius or curved portion 34 of end 16 and by surface 30. As a result, when distal end 16 moves into the working opening, it contacts and bends tab 23 against work surface 21 in the manner illustrated in FIG. 4. The motive power means is then utilized to displace plates 10, 11, 12 upwardly in a direction parallel to but opposite that of arrows B to remove the distal end 16 from the working opening in die 20, after which piece 22 can be removed from the die 20.

As depicted in FIG. 4, displacing the punch plate downwardly in the direction of arrows B causes the proximate end 15 of punch 14 to slide laterally in the punch plate in the direction of arrow A toward the left hand side of the opening collectively formed by openings 13 and 17, and also causes distal end 16 to slide through stationary opening 18 in a rectilinear direction of travel C which diverges away from the direction of travel B of the punch plate.

In many applications of the apparatus of FIGS. 1 to 4, the angle indicated by arrows D is selected so that after the distal end 16 is removed from the working opening after tab 23 is bent to the position shown in FIG. 4, the bent tab 23 "springs back" through an arc away from work surface 21 to a position in which the tab 23 is normal to surfaces 24, 28, 33 and to the portions of piece 22 which are still held intermediate and contact guide plate 19 and surface 24 of die 20.

In the foregoing description, plates 10 to 12 are displaced simultaneously while die 20 and plate 19 remain stationary. If desired, plates 10 to 12 (i.e., the punch plate) can remain stationary while guide plate 19 and die 20 are simultaneously displaced upwardly toward plates 10 to 12 in a direction parallel to but opposite that indicated by arrows B in order to force distal end 16 into the working opening in die 20. Or, the punch plate can move toward guide plate 19 and die 20 at the same time that guide plate 19 and die 20 are displaced toward the punch plate.

Having described my invention in such terms as to enable those skilled in the art to understand and practice it, and having described the presently preferred embodiments thereof, I claim:

1. A punch and die assembly for bending a portion of a piece of sheet material through an obtuse angle, said assembly including (a) a punch plate (11, 12) including an opening;

(b) a punch (14) having a proximate end mounted in said opening in said punch plate and having a distal end extending outwardly from said punch plate and having a distal end extending outwardly from said punch plate, said opening permitting said punch (14) to slide laterally in said plate;

(c) a guide plate-die assembly including (i) a guide plate (19), (ii) a guide hole (18) extending through said guide plate for slidably receiving and guiding said distal end of said punch during movement of said distal end of said punch through said guide hole, (iii) a die (20) having a working opening formed therein adjacent said guide hole, said working opening including a work surface at an angle to a sheet workpiece on said die, said workpiece including a portion positioned over said working opening, said opening in said punch plate, said guide hole, said working opening, and said punch being shaped and dimensioned such that when at least one of the pair comprising (iv) said punch plate, and (v) said guide plate-die assembly is moved toward the other of said pair in a first selected direction of travel, said proximate end of said punch slides in said opening in said punch in a second direction of travel which is lateral to said first selected direction of travel, said distal end of said punch slides rectilinearly through said guide hole at the same time that said proximate end slides laterally in said punch opening, said guide hole being shaped and dimensioned to prevent said distal end from moving laterally in said guide hole in said second direction of travel at the same time said proximate end is sliding in said second direction of travel in said opening in said punch, and said distal end of said punch while moving rectilinearly through said guide hole bends said portion of said workpiece into said workpiece opening toward said work surface and through an angle greater than ninety degrees.

2. A punch and die assembly for bending a portion of a piece of sheet material through an obtuse angle, said assembly including (a) a punch plate (11, 12) including an opening;

(b) a punch (14) having a proximate end mounted in said opening in said punch plate and having a distal end extending outwardly from said punch plate and having a distal end extending outwardly from said punch plate, said opening permitting said punch (14) to slide laterally in said plate;

(c) a guide-die assembly including (i) a die (20) having a working opening shaped to receive said distal end of said punch, said working opening including a work surface at an angle to a sheet workpiece on said die, said workpiece including a portion positioned over said working opening, and (ii) guide means for guiding said distal end of said punch during movement of said distal end of said punch through said working opening, said opening in said punch plate, said guide means, said working opening, and said punch being shaped and dimensioned such that when at least one of the pair comprising (iv) said punch plate, and (v) said guide-die assembly is moved toward the other of said pair in a first selected direction of travel, said proximate end of said punch slides in said opening in said punch in a second direction of travel which is lateral to said first selected direction of travel, said distal end of said punch moves rectilinearly through said working opening at the same time that said proximate end slides laterally in said punch opening, said distal end of said punch being shaped and dimensioned to prevent said distal end from moving laterally in said working opening in said second direction of travel at the same time said proximate end is sliding in said second direction of travel in said opening in said punch, and said distal end of said punch bends said portion of said workpiece into said workpiece opening toward said work surface and through an angle greater than ninety degrees.

3. A punch and die assembly for bending a portion of a piece of sheet material through an obtuse angle, said assembly including (a) a punch plate (11, 12) including an opening;

(b) a punch (14) having a proximate end mounted in said opening in said punch plate and having a distal end extending outwardly from said punch plate and having a distal end extending outwardly from said punch plate, said opening permitting said punch (14) to slide laterally in said plate;

(c) a guide-die assembly including (i) a die (20) having a working opening shaped to receive said distal end of said punch, said working opening including a work surface at an angle to a sheet workpiece on said die, said workpiece including a portion positioned over said working opening, and (ii) guide means guiding said distal end of said punch during movement of said distal end of said punch through said working opening, said opening in said punch plate, said guide hole, said working opening, and said punch being shaped and dimensioned such that when at least one of the pair comprising (iv) said punch plate, and (v) said guide plate-die assembly is moved toward the other of said pair in a first selected direction of travel, said proximate end of said punch slides in said opening in said punch in a second direction of travel which is lateral with respect to said first selected direction of travel, said distal end of said punch slides rectilinearly through said guide hole at the same time that said proximate end slides laterally in said punch opening, said distal end of said punch being shaped and dimensioned to prevent said distal end from moving laterally in said working opening in said second direction of travel at the same time said proximate end is moving in said second direction of travel in said opening in said punch, said distal end of said punch while moving rectilinearly through said working opening bends said portion of said workpiece into said workpiece opening toward said work surface and through an angle greater than ninety degrees, and said punch is prevented from pivoting about a point while said distal end moves rectilinearly through said working opening to bend said portion of said workpiece.

* * * * *